United States Patent [19]

Spence

[11] Patent Number: 4,485,022

[45] Date of Patent: Nov. 27, 1984

[54] LUBRICATING COMPOSITIONS CONTAINING NORMAL-ALKYL SUBSTITUTED 2-THIAZOLINE DISULFIDE ANTIOXIDANTS

[75] Inventor: J. Ronald Spence, Bartlesville, Okla.

[73] Assignee: Phillips Petroleum Company, Bartlesville, Okla.

[21] Appl. No.: 525,912

[22] Filed: Aug. 24, 1983

[51] Int. Cl.[3] ..... C10M 1/48

[52] U.S. Cl. ..... 252/32.7 E; 252/47; 252/402

[58] Field of Search ..... 252/32.7 E, 47, 402

[56] References Cited

U.S. PATENT DOCUMENTS

| | | | |
|---|---|---|---|
| 2,154,096 | 4/1939 | Loane | 252/47 |
| 2,382,906 | 8/1945 | Pedersen et al. | 252/47 X |
| 2,963,433 | 12/1960 | Little, Jr. et al. | 252/47 X |
| 3,228,952 | 1/1966 | Reifschneider | 252/47 X |
| 4,104,179 | 8/1978 | Colclough | 252/47 X |

FOREIGN PATENT DOCUMENTS

| | | | |
|---|---|---|---|
| 767734 | 2/1957 | United Kingdom | 252/47 |

*Primary Examiner*—Andrew Metz

*Attorney, Agent, or Firm*—Howard D. Doescher

[57] ABSTRACT

Lubricating oils are protected against oxidation by the addition of a stabilizing amount of at least one n-alkyl substituted 2-thiazoline disulfide.

14 Claims, No Drawings

LUBRICATING COMPOSITIONS CONTAINING NORMAL-ALKYL SUBSTITUTED 2-THIAZOLINE DISULFIDE ANTIOXIDANTS

This invention relates to improved additives for lubricants. In one aspect, this invention relates to lubricating compositions containing as an additive at least one n-alkyl substituted 2-thiazoline disulfide. In accordance with another aspect, this invention relates to a method of stabilizing lubricating oils against oxidative degradation by the addition of at least one n-alkyl substituted 2-thiazoline disulfide. In accordance with a further aspect, this invention relates to improved lubricants containing at least one n-alkyl-2-thiazoline disulfide.

Advances in the design and construction of internal combustion engines to produce improved and more efficient and economical engines have presented many problems in the lubrication of the modern internal combustion engine. To meet the increased severe demands upon engine lubricants many types of lubricant additives have been developed to obtain certain desired characteristics thereof. Among the more effective addition agents which have been developed for compounding with lubricants are many sulfur-containing organic compounds. However, few of these compounds have been considered entirely adequate for the purpose for which they were intended because they did not sufficiently improve one or more of the lubricating properties. For example, they did not improve the resistance to oxygen and the like. The present invention resides in providing an additive that will stabilize lubricating compositions against oxidative degradation.

An object of this invention is to provide improved additives exhibiting reduced oxidative degradation tendencies in lubricating oils.

Another object of this invention is to provide improved lubricating compositions utilizing the additives of the invention.

A further object of this invention is to provide novel compounds useful as ashless lubricant additives.

A further object is to lower the phosphorus content of automobile engine oil.

Other objects, aspects, as well as the several advantages of the invention will be apparent to those skilled in the art upon reading the specification and the appended claims.

Thus, according to the invention there is provided lubricating compositions exhibiting improved characteristics containing at least one n-alkyl substituted 2-thiazoline disulfide.

In accordance with another embodiment of the invention lubricating compositions are provided containing an effective stabilizing amount of at least one n-alkyl substituted 2-thiazoline disulfide.

Further, according to the invention, there is provided a method of stabilizing lubricating compositions against oxidative degradation which comprises incorporating therein a stabilizing amount of at least one n-alkyl substituted 2-thiazoline disulfide.

The additives of the invention are n-alkyl-2-thiazoline disulfides wherein the n-alkyl group can range from 1 to about 20 carbon atoms, inclusive, per alkyl group. The disulfides of the invention can be represented by the formula

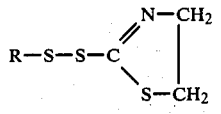

wherein R is a normal alkyl group having from 1 to 20, inclusive, carbon atoms.

Representative examples of suitable compounds that can be used falling within the scope of the above-described formula include methyl-2-thiazoline disulfide, n-propyl-2-thiazoline disulfide, n-butyl-2-thiazoline disulfide, n-hexyl-2-thiazaline disulfide, n-octyl-2-thiazoline, disulfide n-decyl-2-thiazoline disulfide, n-dodecyl-2-thiazoline disulfide, n-eicosyl-2-thiazoline disulfide, and the like, and mixtures thereof.

The lubricating oils to which the invention compositions can be added include any suitable mineral oil of lubricating viscosity such as those used for compounding lubricating oils of SAE 10 to SAE 50 viscosity. These oils can be derived from suitable naphthenic, paraffinic, and mixed base crudes as well as mixtures of one or more types. The additives of the invention has special advantages when employed with paraffinic types of oil such as are obtained by solvent extraction of a suitable refinery stream. Many suitable lubricating compositions are available as commercial products such as those used as motor oils, fuel oils, gear oils, automatic transmission oils, and the like. A lubricating oil can also contain other additives such as thickeners and the like.

Lubricating oil for internal combustion engines generally contain an antioxidant-antiwear zinc additive, such as zinc dialkyldithiophosphate, with the concentration of zinc being in the range 0.1–0.15 weight percent of the finished oil. The zinc and the phosphorus can be detrimental to other parts of the engine operation as it is desirable to have a non-metal, non-phosphorus substitute to permit the use of a lower concentration of zinc and phosphorus in motor oil. The compounds of the instant invention, since they are antioxidants, permit the use of lower concentrations of the zinc compound in the range 0.04–0.07 weight percent zinc in the finished oil. Use of 0.04–0.07 weight percent zinc without the inventive additive would result in excessive thickening of the oil during normal engine operations.

Generally speaking the additives of this invention can be added to a base lubricating oil in any amount sufficient to produce the desired degree of improvement. More specifically, an amount of additive used according to the invention will be an antioxidant stabilizing amount which is sufficient to stabilize the lubricating composition against oxidative degradation. For example, the additives can be used in amounts ranging from 0.05 to about 10 weight percent of the finished oil. The presently preferred concentration of product additive is in the range of about 0.1 to about 5 weight percent of finished oil.

Other agents than those which are mentioned can be present in the lubricant composition, such as dyes, pour point depressants, heat thickened fatty oils, sulfurized fatty oils, sludge dispersers, foam suppressants, thickeners, viscosity index improvers, oiliness agents, resins, rubber, molten polymers and the like.

The effectiveness of the herein described thiazoline disulfides stabilizing oxidative degradation of lubricating oils is demonstrated by the following examples.

EXAMPLE I

The following inventive and comparative runs were conducted to demonstrate the oxidative stabilization achieved by the inventive additive.

In the following bench test 1500 ppm nitrous oxide/air mixture was used as the oxidizing agent on a fully formulated 10W30 engine oil. The only difference on the two formulations was the oxidation inhibitor as shown in Table I.

TABLE I

| Run# | oxidation inhibitor | hours elapsed before oxidation break point |
|---|---|---|
| 1 | 1.0 vol % Lubrizol 1395[a] | 49 |
| 2 | 0.5 vol % Lubrizol 1395 + 1.0 vol % n-dodecyl-2-thiazoline disulfide | >80 |

[a]Commercial zinc dialkyldithiophosphate (antioxidant and antiwear additive)

For each run, 30 g of test oil in a test tube was heated to 150° C. with an immersed copper electric wire while the above oxidizing agent bubbled through the oil at a rate of 100 cc gas per min. At about 20 hr intervals the level of oxidation was determined by differential infrared analysis. The intensity of the 1720 $cm^{-1}$ carbonyl stretching band was used in the measure of oxidation. A plot of the band intensity versus time in each run showed a break point at which oxidation sharply increased. This break point is a measure of the antioxidative capacity of the test oil.

The test results in Table I show that n-dodecyl-2-thiazoline disulfide is an effective antioxidant, and can replace some of the zinc dialkyldithiophosphate used in all automobile motor oils.

EXAMPLE II

The n-alkyl-2-thiazoline disulfide additive was further evaluated for antioxidant properties in a Sequence III-D high temperature oxidation and engine wear test for evaluating automobile engine oils as described in ASTM Special Technical Publication 315 H.

For comparative purposes tert-octyl-2-benzothiazyl disulfide (disclosed in U.S. Pat. No. 3,878,117) was also tested.

The formulations tested were as follows:

FORMULATIONS

| | Volume Percent | | |
|---|---|---|---|
| | A | B | C |
| Mid-continent SAE 10 stock | 33.1 | 33.1 | 33.1 |
| Mid-Continent SAE 20 stock | 33.0 | 33.0 | 33.0 |
| Phil-Ad 300[a] | 2.2 | 2.2 | 2.2 |
| Edwin Cooper E 686[b] | 1.5 | 1.5 | 1.5 |
| Lubrizol 934[c] | 4.1 | 4.1 | 4.1 |
| Phil-Ad VII solution[d] | 23.0 | 23.1 | 23.0 |
| Exxon ECA 5118[e] | 0.6 | 0.6 | 0.6 |
| Lubrizol 1395[f] | 0.5 | 0.5 | 0.5 |
| n-octyl 2-thiazoline disulfide | 1.5 | — | — |
| tert-octyl-2-thiazoline disulfide | — | 1.5 | — |
| tert-octyl-2-benzothiazyl disulfide | — | — | 1.5 |

[a]Overbased calcium petroleum sulfonate
[b]Commercial calcium phosphonate phenate
[c]Commercial alkyl succinic ester
[d]Commercial butadiene-styrene copolymer viscosity index improver diluted in oil
[e]Commercial pour depressant
[f]0.5 vol % of 1395 is equivalent to 0.05 wt % zinc A summary of the Sequence III D test results is presented in Table II

TABLE II

| Formulation | A | B | C | pass specification for S.F. grade |
|---|---|---|---|---|
| Viscosity Increase, % at 40.0° C. | | | | |
| at 16 hr | 50.9 | 76.9 | 32.1 | |
| 32 hr | 75.6 | 109.1 | 508.5 | |
| 48 hr | — | 290.9 | a | |
| 56 hr | 112.2 | 1584.2 | b | |
| 64 hr | 124.5 | a | b | 375 max. |
| average engine sludge (10 = clean) | 9.8 | 9.3 | 9.3[b] | 9.2 min. |
| average engine varnish (10 = clean) | 9.3 | 9.3 | 9.3[b] | 9.2 min. |
| average cam plus lifter wear (inches) | 0.00016 | 0.0023 | 0.0018[b] | 0.0040 max. |
| average bearing weight loss (mg) | 2.87 | 203.0 | 283.0[b] | |
| number of sluggish rings | 0 | 14 | 21[b] | |

[a]too viscous to measure
[b]at 42 hr. test terminated as oil too viscous to operate engine.

These data show oxidative thickening of the oil is controlled in inventive formulation A, containing n-octyl-2-thiazoline disulfide while control formulation B with tert-octyl 2-thiazoline disulfide failed (exceeded 375% viscosity increase) in less than 56 hrs and control formulation C failed in less than 32 hrs. Also control formulations B and C gave excessive bearing weight loss. The data also show that the formulation containing the n-alkyl group in the inventive additives passes the above III-D test while the formulation containing the tert-alkyl group attached to 2-thiazoline fails in excessive viscosity. Thus the n-alkyl group is essential for the inventive additive.

What is claimed is:

1. An improved lubricating composition comprising a major amount of a mineral lubricating oil having incorporated therein a small minor effective amount of at least one normal-alkyl substituted 2-thiazoline disulfide sufficient to stabilize the resulting composition toward oxidation.

2. A composition according to claim 1 wherein said alkyl contains from 1 to 20, inclusive, carbon atoms.

3. A composition according to claim 1 wherein said disulfide is n-octyl-2-thiazoline disulfide or n-dodecyl-2-thiazoline disulfide.

4. An improved lubricating composition comprising a major amount of a mineral lubricating oil having incorporated therein a small minor effective amount ranging from about 0.05 to about 10 weight percent of at least one normal-alkyl substituted 2-thiazoline disulfide sufficient to stabilize the resulting composition toward oxidation.

5. A composition according to claim 4 wherein the amount of disulfide present ranges from about 0.1 to about 5 weight percent based on total lubricating composition.

6. A composition according to claim 4 which additionally contains a zinc dialkyldithiophosphate compound in an amount sufficient to provide from about 0.04 to about 0.07 weight percent zinc in the finished oil.

7. A composition according to claim 6 wherein said disulfide is n-octyl-2-thiazoline disulfide or n-dodecyl-2-thiazoline disulfide.

8. A method of stabilizing a mineral lubricating oil against oxidative degradation which comprises incorporating therein a small but effective amount of at least one n-alkyl substituted 2-thiazoline disulfide sufficient to stabilize the resulting composition toward oxidation.

9. A method according to claim 8 wherein the amount of stabilizer present ranges from about 0.05 to about 10 weight percent of the lubricating oil.

10. A method according to claim 8 wherein said alkyl contains from 1 to 20, inclusive, carbon atoms.

11. A method according to claim 10 wherein the n-alkyl is n-octyl or n-dodecyl.

12. A method according to claim 8 wherein the amount of disulfide present ranges from about 0.1 to about 5 weight percent of the lubricating oil.

13. A method according to claim 8 for reducing the amount of zinc required in the finished oil which comprises incorporating said disulfide into a lubricating oil containing a zinc dialkyldithiophosphate compound.

14. A method according to claim 13 wherein the finished oil contains from about 0.04 to about 0.07 weight percent zinc.

* * * * *